US006789358B2

(12) United States Patent
Procton et al.

(10) Patent No.: US 6,789,358 B2
(45) Date of Patent: Sep. 14, 2004

(54) THRESHOLD ASSEMBLY WITH UNITARY MOLDED SUBSTRATE AND JAMB BOOT SUBASSEMBLY

(75) Inventors: Bruce I. Procton, High Point, NC (US); Joel S. Bennett, Greensboro, NC (US)

(73) Assignee: Endura Products, Inc., Colfax, NC (US)

( * ) Notice: Subject to any disclaimer, the term of this patent is extended or adjusted under 35 U.S.C. 154(b) by 0 days.

(21) Appl. No.: 10/004,613

(22) Filed: Nov. 1, 2001

(65) Prior Publication Data

US 2002/0078641 A1 Jun. 27, 2002

Related U.S. Application Data

(60) Provisional application No. 60/244,973, filed on Nov. 1, 2000.

(51) Int. Cl.[7] ..... E06B 1/70

(52) U.S. Cl. ..... 49/471; 49/467; 49/468; 52/204.1

(58) Field of Search ..... 49/467, 468, 469, 49/471; 52/211, 717.01, 717.02, 717.03, 717.04, 717.05, 717.06

(56) References Cited

U.S. PATENT DOCUMENTS

| | | | | | |
|---|---|---|---|---|---|
| 3,900,967 | A | * | 8/1975 | Bursk et al. | 49/468 |
| 5,136,814 | A | * | 8/1992 | Headrick | 49/468 |
| 5,611,173 | A | * | 3/1997 | Headrick et al. | 49/468 |
| 6,289,635 | B1 | * | 9/2001 | Procton et al. | 49/467 |
| 6,345,477 | B1 | * | 2/2002 | Kepler et al. | 52/204.1 |
| 2001/0051243 | A1 | * | 12/2001 | Godavarti et al. | 428/36.9 |

* cited by examiner

*Primary Examiner*—Jerry Redman
(74) *Attorney, Agent, or Firm*—Womble Carlyle Sandridge & Rice, PLLC

(57) ABSTRACT

A threshold assembly includes a unitary compression molded plastic composite body formed to define an upwardly open threshold cap channel, jamb boots at its ends, and a support substrate outboard of the channel. An extruded aluminum sill plate is snapped into place on the plastic body and a vertically adjustable threshold cap is disposed in the upwardly open channel. Drain channels may be formed in the plastic body to direct water outwardly and away from the threshold assembly. The plastic body forms a stable foundation that will not rot, swell, or rack in the presence of moisture and fabrication of the assembly is greatly simplified as compared to traditional threshold assemblies.

28 Claims, 11 Drawing Sheets

THRESHOLD ASSEMBLY WITH UNITARY MOLDED SUBSTRATE AND JAMB BOOT SUBASSEMBLY

REFERENCE TO RELATED APPLICATION

The benefit of the filing date of U.S. provisional patent application serial No. 60/244,973 filed on Nov. 1, 2000 is hereby claimed.

TECHNICAL FIELD

This invention relates generally to entryway systems for homes and commercial buildings and more specifically to continuous threshold assemblies of entryway systems.

BACKGROUND

Entryway systems used in building construction generally include a pair of vertically extending door jambs and a head jamb that frame the entryway and receive a hinged door. An elongated threshold assembly is attached at its ends to the bottoms of the door jambs and spans the bottom of the entryway. Many modern threshold assemblies include an extruded aluminum frame having an upwardly open channel from which a sill slopes outwardly and downwardly. A wood or composite foundation or, in some cases, just support blocks are attached at spaced intervals to the underneath side of the frame to provide support and rigidity to the assembly. A threshold cap, which may be made of plastic or wood, is disposed in the upwardly open channel and underlies a closed door mounted in the entryway. The threshold cap usually is vertically adjustable to engage and form a seal with a flexible sweep attached to the bottom of the door.

Traditionally, the bottoms of door jambs, which usually are made of wood, have been attached to the ends of the threshold assembly by milling a specially shaped haunch in the jamb bottom ends to accommodate the profile of the threshold assembly and fitting and stapling the milled bottoms of the jambs to the threshold assembly. A portion of the haunch overlaps and sits atop the sloped sill deck of the threshold assembly. Problems with this traditional technique are many. For instance, since virtually every brand and style of threshold assembly has a different shape with a sill deck that extends at a different angle, the jamb haunches in each case must be precisely and specially milled to fit the particular threshold assembly to which they are to be attached. This means that pre-hangers must own and operate expensive and accurate milling machinery and must maintain a number of different shaped milling cutters to accommodate the various configurations of threshold assemblies.

Recently, a need has been recognized for an entryway system designed to eliminate the requirement that jamb bottoms be accurately milled to mate with the ends of a threshold assembly. Related needs include the standardization of jamb length for a wide variety of threshold designs such that pre-hangers do not have to stock different length jambs, and the need to inhibit rotting and deterioration due to water collection at the junction of the jambs and the threshold assembly. In response to these and other needs, we have previously proposed a plastic jamb boot that attaches to each end of the extruded aluminum threshold frame. Our proposed jamb boot is described in detail in our pending U.S. patent application Ser. No. 09/902,042 entitled Threshold Assembly with Pre-fitted Draining Jamb Boots and Pre-fitted Mull Boots, the disclosure of which is hereby incorporated by reference (hereinafter the "incorporated reference").

Essentially, the jamb boot disclosed in the incorporated reference is an injection molded plastic attachment that is preformed with the appropriately configured haunch for mating with the end of a jamb. The jamb boot has a flat upper surface to which a square cut bottom end of a wooden jamb is attached. The jamb boot, which also may incorporate draining features, prevents moisture contact with the bottoms of the wooden jambs, allows wooden jambs to have simple square cut rather than accurately milled bottom ends, and provides for the standardization of jamb length for a wide variety of threshold assembly designs.

While our plastic jamb boot addresses many of the problems discussed above, other problems still persist. For example, the manufacturing steps required to attach a wood substrate or to attach wooden or composite support blocks to the underneath side of an extruded aluminum threshold are labor intensive. Further, since these components rest directly on a subfloor when the threshold is installed, they can soak up moisture and rot or deteriorate over time. When this happens, the substrate or support blocks can swell, which causes the aluminum threshold to deform or rack in place. Other problems exist such as, for example, the labor intensive process of installing screw bosses or T-nuts in the region of a wood substrate that forms the floor of the threshold cap channel for receiving the adjusting screws of the threshold cap.

A need persists, therefore, for a threshold assembly that may incorporate all the aforementioned advantages of plastic jamb boots attached to traditional threshold assemblies, and also that incorporates efficient draining features, eliminates the need and manufacturing steps involved in attaching support blocks and wooden substrates to the underside of aluminum frames, that eliminates swelling and deterioration of a substrate in the presence of moisture, and generally that simplifies the fabrication process and results in a threshold assembly of superior durability and quality. It is to the provision of such a threshold assembly and to an entryway system that incorporates such an assembly that the present invention is primarily directed.

SUMMARY OF THE INVENTION

Briefly described, the present invention, in a preferred embodiment thereof, comprises a unique threshold assembly for installation in an entryway spanning the bottom ends of the vertical jambs of the entryway. The threshold assembly includes an elongated preferably compression molded unitary plastic body that is formed to define an upwardly open channel along its inside edge portion for receiving a threshold cap. The body further forms a support substrate that extends forwardly from the channel to an outside edge. An interior trim or nosing is integrally formed along the interior edge of the plastic body and defines the inside wall of the upwardly open channel. In one embodiment, a jamb boot is integrally molded at either end of the plastic body. Each jamb boot is profiled to match the profile of a wood jamb and has a level flat top surface for attaching the jamb boot to a square-cut bottom end of a wooden jamb with screws. An extruded aluminum sill plate is snapped into place on the plastic body covering and supported by at least a portion of the support substrate. When so attached, the sill plate projects outwardly and slopes downwardly from the upwardly open channel in the traditional way to provide a safe and durable tread surface.

In one embodiment, a sill plate attachment slot is formed along the junction between the upwardly open channel and the support substrate and the aluminum sill plate is formed with a barbed tab or flange that is received and secured within the attachment slot. The attachment slot communicates with transverse drain channels formed at the ends of the support substrate and these drain channels extend to the outside edge of the assembly. The drain channels collect rainwater and direct it away from the threshold assembly to prevent rot and deterioration of the sub-floor beneath the threshold assembly. In another embodiment, the sill plate is formed with a vertical wall along its inside edge that forms the outside wall of the upwardly open channel when the sill plate is installed. The slot is formed along the bottom outside corner of the channel by an array of inwardly projecting tabs and the wall of the sill plate has a downwardly extending portion that covers the tabs and snaps into the slot. In this embodiment, an upwardly extending portion of the wall forms a dam and the outside wall of the upwardly open channel.

The molded plastic body may be configured in a variety of ways. For example, the support substrate may be formed with a block or open rib structure or with a full or closed rib structure, or it may be solid. The support substrate may be formed with substantially solid end portions sized to accommodate cutting, honing, and notching. Mull post support regions may be formed in the support substrate for underlying and supporting and for providing an attachment location for mull posts or mull boots in sidelight entryways. In any event, the body preferably is formed by a compression molding process from slightly blown or cellular plastic, which may include a filler such as wood flour, rice hulls, or equivalents thereto. A traditional threshold cap is disposed in the upwardly open channel and a plastic nosing cover may be snapped in place over the inside nosing to provide a pleasing interior appearance. When assembled, the threshold assembly of the invention resembles a traditional continuous threshold assembly, but is far simpler to assemble, is resistant to rot, swelling, and warpage, and has a longer expected life than prior art threshold assemblies.

Thus, a unique new threshold assembly is now provided that successfully addresses the needs discussed above. The assembly is simple to fabricate by snapping an aluminum sill plate, threshold cap, and nosing cover onto the molded plastic body. The plastic substrate provides support for the sill plate and is not subject to swelling or deterioration in the presence of moisture. When integral jamb boots are included, the threshold assembly accommodates standard length square-cut jambs and protects the jamb bottoms from rotting due to moisture absorption. These and other objects, features, and advantages of the invention will become more apparent upon review of the detailed description set forth below, when taken in conjunction with the accompanying drawings, which are briefly described as follows.

DETAILED DESCRIPTION OF THE PREFERRED EMBODIMENTS

Figure 1:
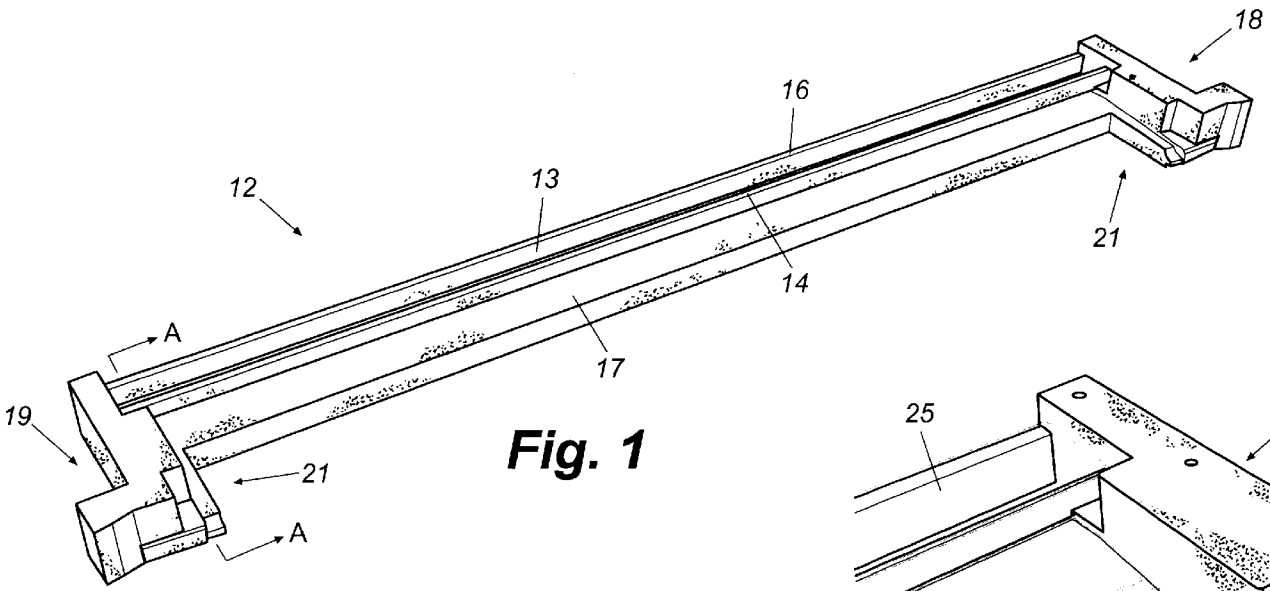
FIG. 1 is a perspective view of a molded plastic threshold body that embodies principles of the invention in one preferred form.

Referring now in more detail to the drawings, in which like numerals refer, where appropriate, to like parts throughout the several views, FIGS. 1 through 5 illustrate a threshold assembly with a unitarily molded plastic body that includes a support substrate and jamb boot subassembly and that embodies principles of the invention in a first preferred form. The threshold assembly 11 comprises a unitarily molded plastic body 12 that is configured to define a longitudinally extending upwardly open channel 13. The channel 13 is flanked along its outside edge by upstanding dam 14 and along its inside edge by an integrally formed trim piece or nosing 16. The dam 14 and nosing 16 form the outside and inside walls respectively of the upwardly open channel 13. A support substrate 17 projects outwardly a predetermined distance from the upstanding dam 14. A right hand jamb boot 18 is integrally formed at one end of the plastic body 12 and a left jamb boot 19 is formed at the other end of the plastic body 12. The right hand jamb boot 18 is profiled to match or to complement the profile of a wooden jamb and brick mold assembly and includes a flat level top surface 26, screw holes 27, and a brick mold portion 28. In use, a traditional wooden jamb and brick mold having a square cut bottom end is positioned atop the jamb boot 18 and attached with screws. The left jamb boot 19 is identical in function to the right jamb boot except that it is a mirror image. The plastic body 12 may be formed by a traditional injection molding process, but preferably is formed by a compression molding process. The material from which the body 12 is molded preferably comprises a suitable plastic that is slightly blown to form a cellular core and that is mixed with a filler and stabilizer such as, for example, wood flour, rice hulls, or the like, as discussed in more detail below. The body also may be molded from non-blown non-filled plastic if desired.

In this embodiment, a sill plate mounting flange or projection 21 is formed adjacent each of the jamb boots 18 and 19 and extends forwardly to a contoured forward edge 30. A sill plate attachment slot 22 is formed in the substrate along the junction between the support substrate 17 and the upstanding dam 14. A drain channel 23 is formed at the junctions between the sill plate attachment projections 21 and the jamb boots 18 and 19 and each drain channel terminates in a forward drain channel mouth 29. The drain channels communicate at one end with the ends of the sill plate attachment slot 22.

Figure 2:
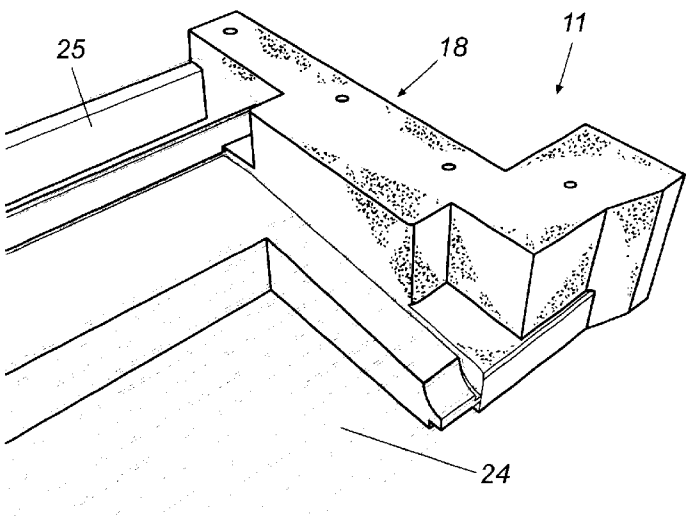
FIG. 2 is an enlarged view of the right end of the body of FIG. 1 showing the unitary jamb boot and a sill plate and threshold cap snapped into place on the body.
Figure 3:
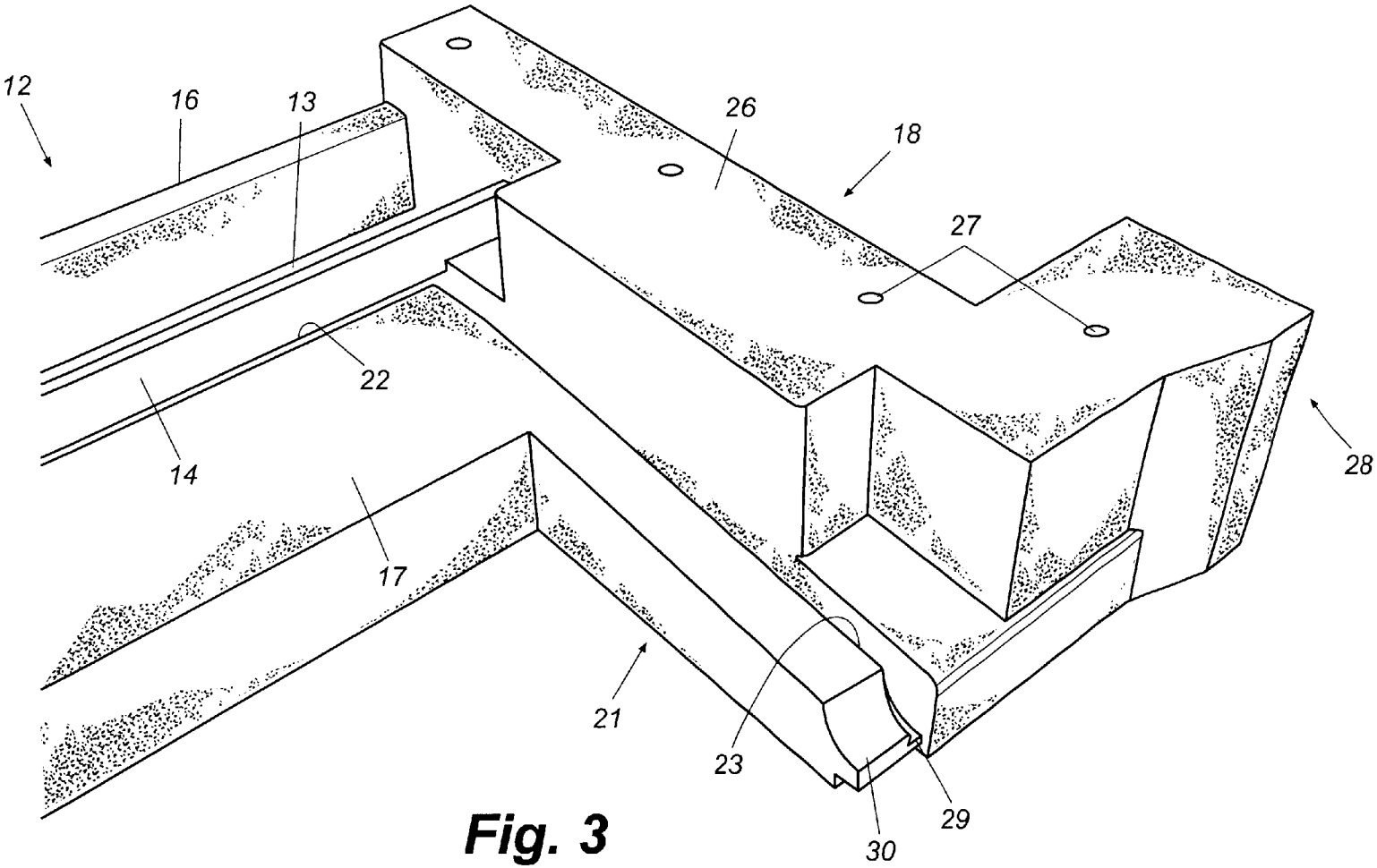
FIG. 3 is a further enlarged view of the right end of the body of FIG. 1 without the sill plate and threshold cap and illustrating better the integral jamb boot of the body.
Figure 4:
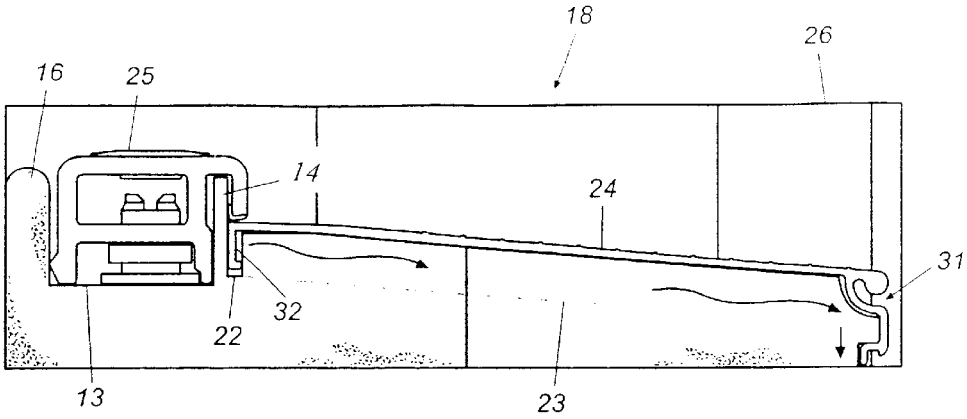
FIG. 4 is a cross-sectional view of a threshold assembly according to the invention illustrating the draining channels formed in the ends of the plastic body.

As illustrated in FIGS. 2 and 4, an extruded aluminum sill plate 24 is attached to the plastic body 12 and forms the main upper tread surface of the threshold assembly. Referring to FIG. 4, the sill plate 24 has a contoured outside edge portion 31 configured to fit over the compatibly contoured forward edges 30 of the sill plate projections 21 as shown. A downwardly projecting barbed tab 32 is formed along the inside edge of the sill plate and is positioned and configured to be snapped into place within the sill plate attachment slot 22 to hold the aluminum sill plate securely in place on the plastic body. Also as shown in FIGS. 2 and 4, the upwardly open channel 13, which is flanked by nosing 16 and dam 14, is sized to receive a traditional non-adjustable or vertically adjustable threshold cap 25 for underlying a closed door.

Figure 5:
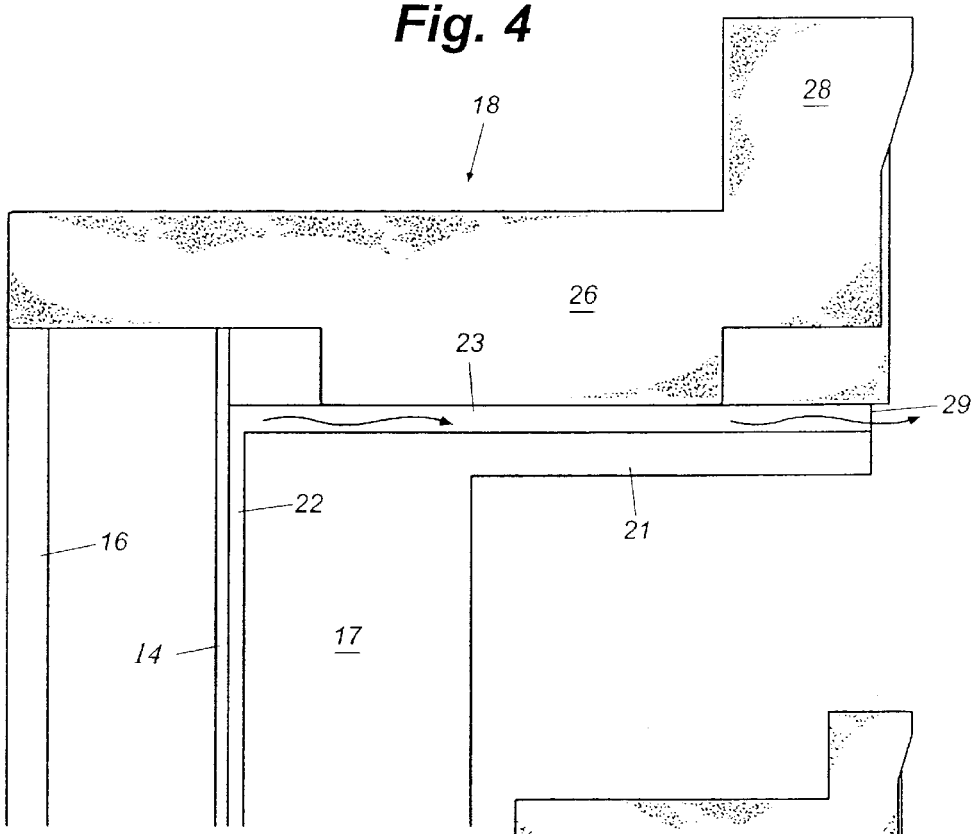
FIG. 5 is a top plan view of an end of the plastic body without the sill plate and threshold cap illustrating draining channels of the body.
Figure 5A:
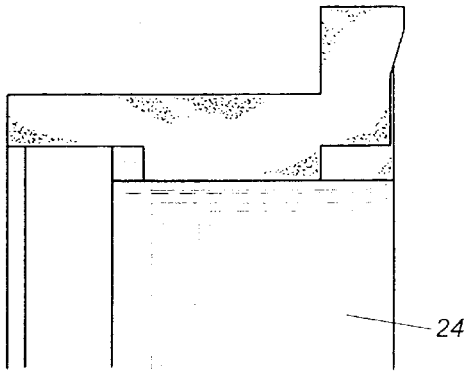
FIG. 5*a* is a top plan view of the body of FIG. 5 with threshold cap and sill deck attached showing the flow of water through the drain slots of the body.

As best illustrated in FIGS. 4 and 5, the drain channel 23, which communicates with the ends of the sill plate attachment slot 22, form a draining system for the threshold assembly. More specifically, rain water that may collect along the upper edge of the sill plate and seep into the sill plate attachment slot 22 is channeled away from the threshold assembly by flowing to the ends of the sill plate attachment slot, into the drain channels, and out the drain channel mouths 29. Rainwater that may flow down the vertical jambs of an entryway likewise enters the drain channels 23 and is directed away from the threshold assembly in the same manner. In this way, there is no path for water to leak beneath the threshold assembly and rot or otherwise deteriorate the subfloor upon which it rests and all water is drained to the outside edge of and away from the threshold assembly.

FIGS. 6 through 9 illustrate an alternate embodiment of the threshold assembly of the present invention. Referring to these drawing figures, the threshold assembly 41 includes a molded plastic body 42 that, like the previous embodiment, is formed to define an upwardly open channel 51 flanked along its inside edge by a nosing 53 and along its outside edge by an upstanding dam 54, which form the inside and outside walls respectively of the upwardly open channel. The body may be fabricated by any appropriate molding process such as, for example, by injection molding. Preferably, however, it is formed in a compression molding process from a composite of slightly blown (cellular) plastic mixed with wood flour, rice hulls, or another appropriate filler material. A support substrate 56 projects outwardly from the channel 51 to a contoured forward edge 58. An array of transversely extending ribs 57 form spaced support members along the support substrate for underlying and supporting an extruded aluminum sill plate 59 attached to the plastic body.

Figure 6:
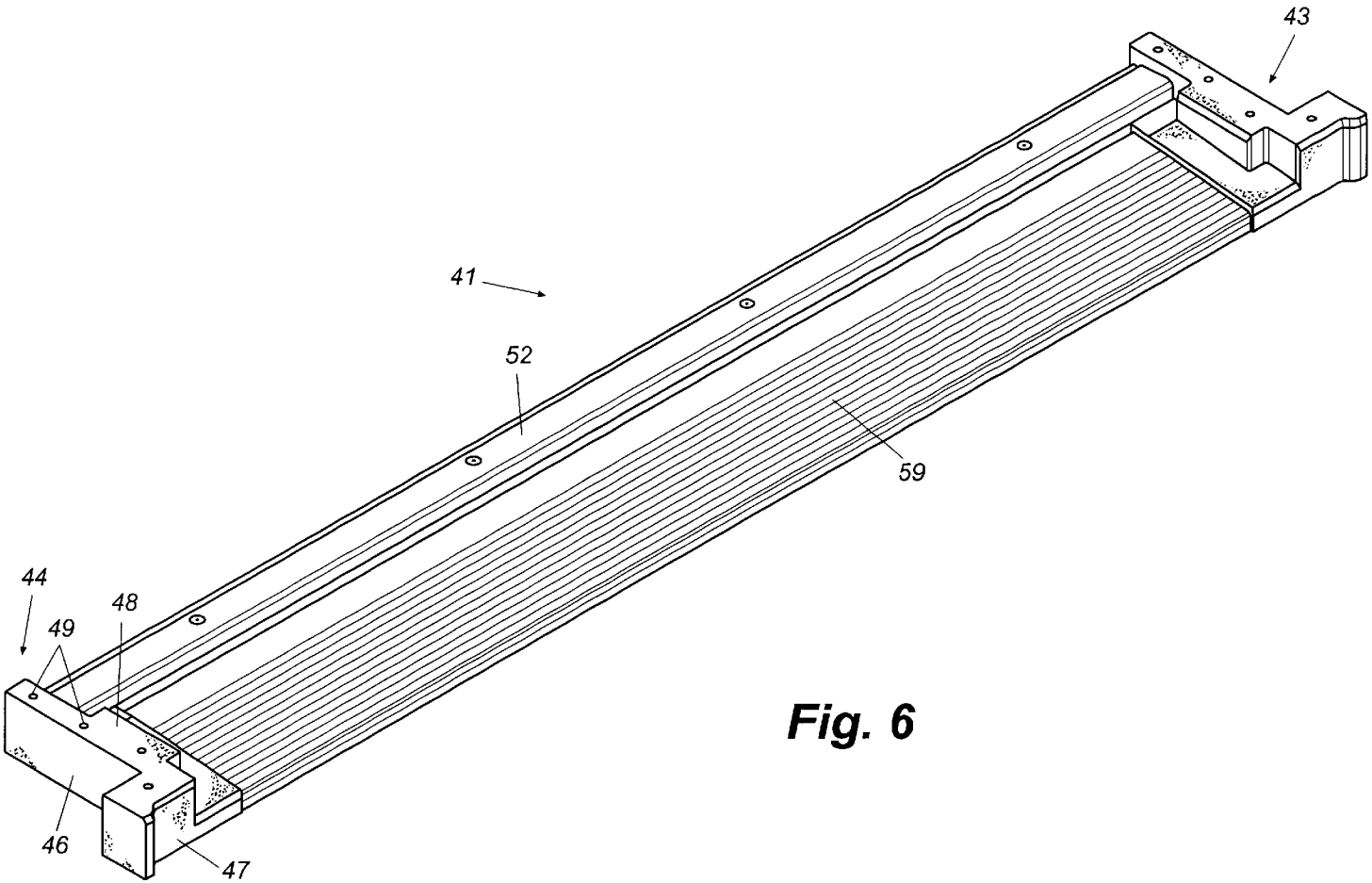
FIG. 6 is a perspective view of an assembled threshold assembly that embodies principles of the invention in an alternate form.
Figure 7:
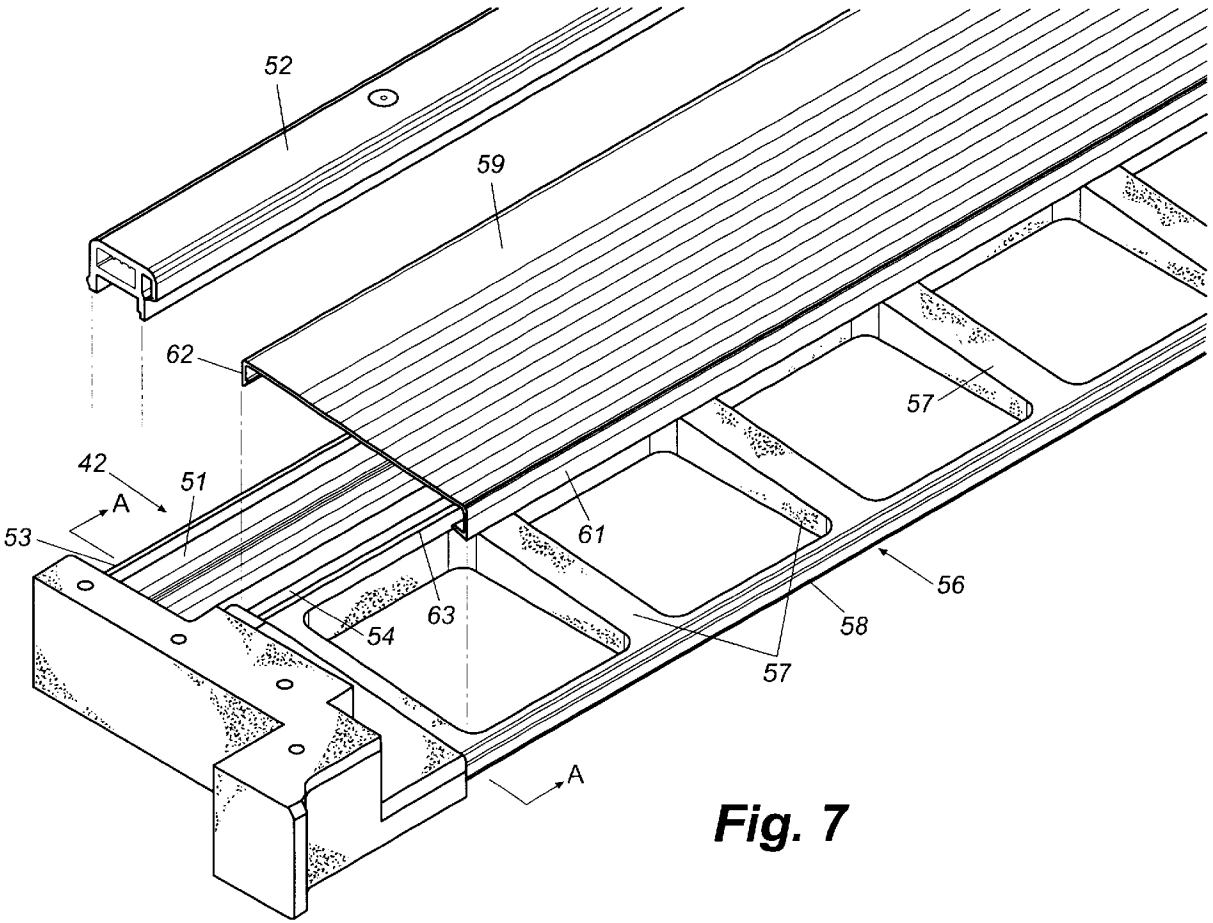
FIG. 7 is an enlarged exploded perspective of the left end of the threshold assembly of FIG. 6 illustrating a block rib support structure.

As best seen in FIG. 6, a right hand jamb boot 43 is molded at one end of the plastic body and a left-hand jamb boot 44 is molded at the other end. As with the previous embodiment, each of the jamb boots has a flat level upper surface 48 for attachment to the square cut bottom end of a wooden jamb by means of screws extending through screw holes 49. A brick mold portion 47 is configured to align with and complement the shape of the brick mold of a traditional wood jamb attached to the boots. The upwardly open channel 51 formed in the plastic body is sized to receive a non-adjustable or vertically adjustable threshold cap 52 as described above and may receive a panel cap in configurations intended for sidelight entryways.

Figure 8:
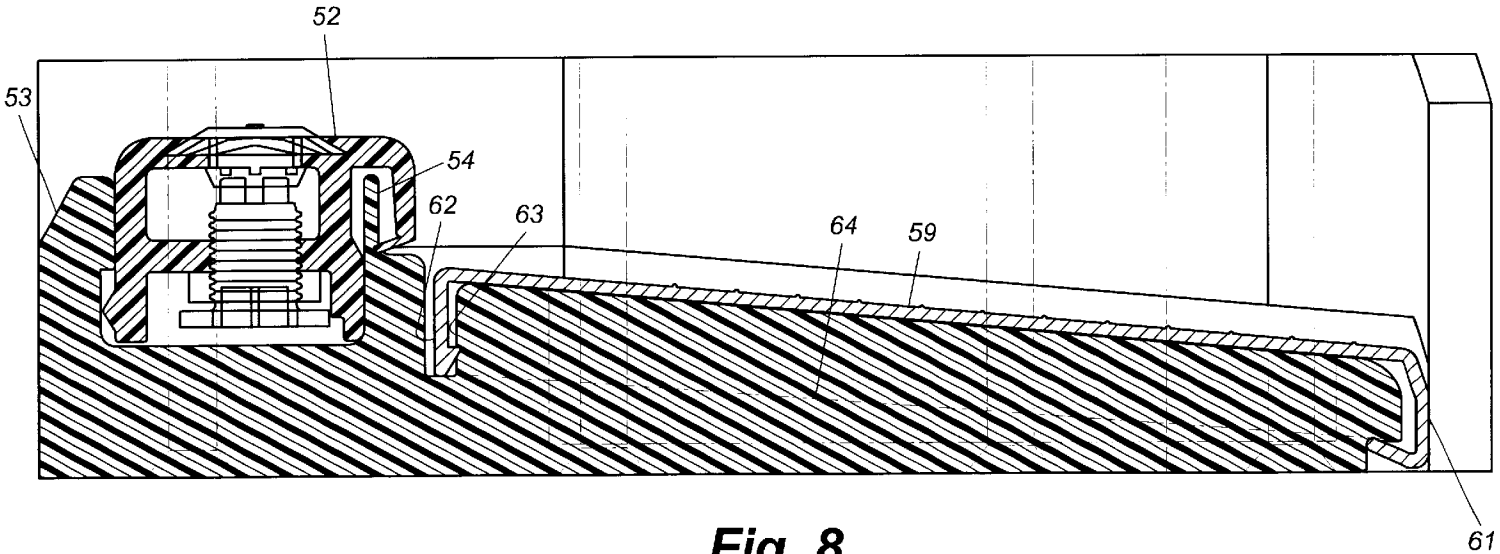
FIG. 8 is a cross-sectional view taken along A—A of the threshold assembly of FIG. 7 illustrating various elements thereof.
Figure 9:
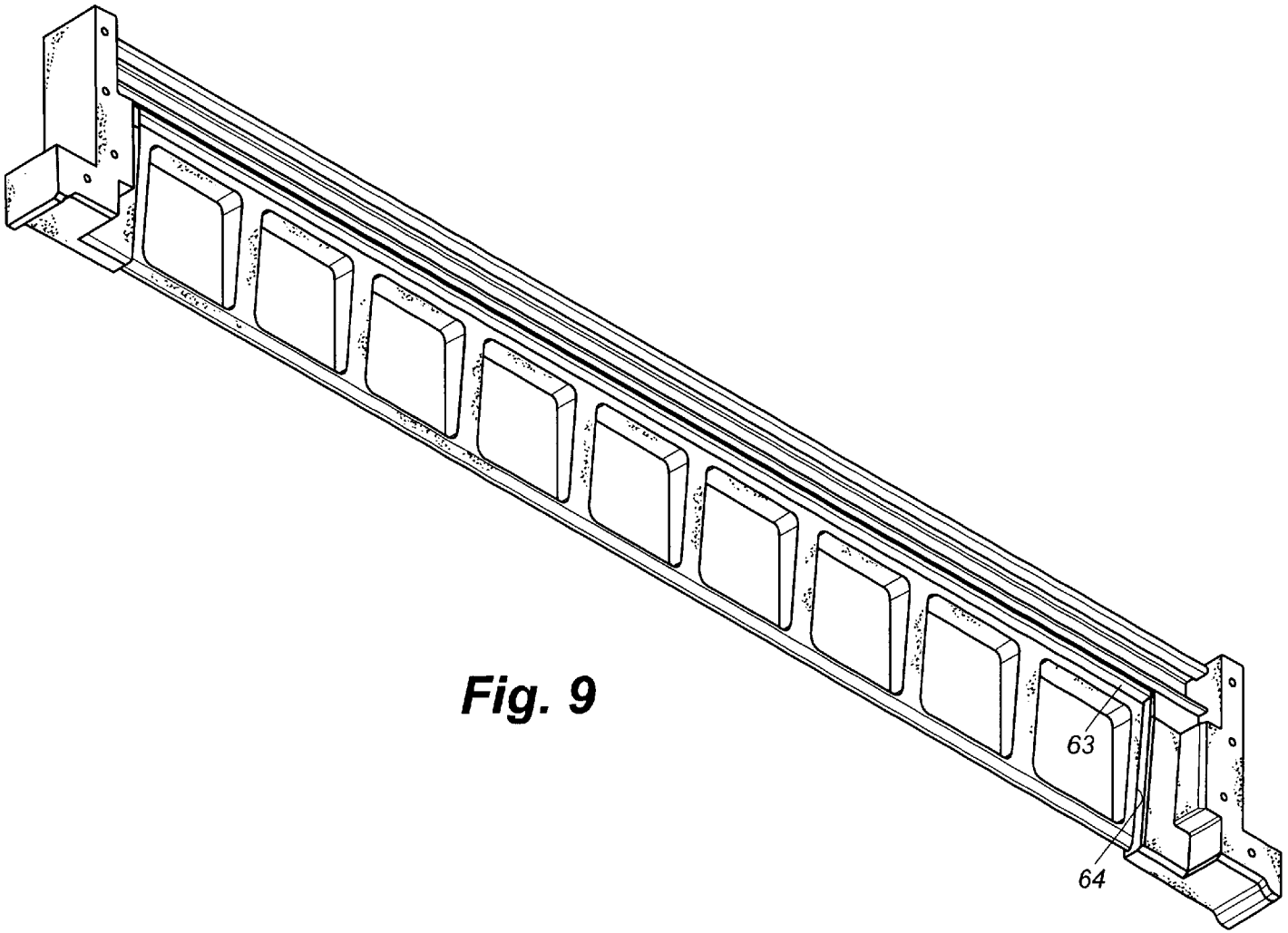
FIG. 9 is a perspective view of the unitary plastic body of the threshold assembly of FIG. 6.

A sill plate attachment slot 63 (FIG. 8) is formed in the support substrate along the interface between the support substrate 56 and the upstanding dam 54. As with the previous embodiment, the sill plate attachment slot 63 communicates at its ends with respective drain channels 64 (best seen in FIG. 9) that extend to the forward edge of the plastic body. As best seen in FIG. 8, the extruded aluminum sill plate 59 has a contoured or hooked forward edge 61 adapted to hook onto the compatibly contoured forward edge of the plastic body and a downwardly projecting barbed tab 62 sized and positioned to snap into the sill plate attachment slot 63. In this way, the aluminum sill plate is easily attached to the plastic body with a simple fabrication step and forms a durable and safe tread surface upon which to step when traversing the threshold.

As with the previous embodiment, rain water that may seep into the slot 63 is directed to the ends of the slot and, from there, flows down the drain channels 64 to the front edge of the threshold assembly from where it is expelled from and flows away from the threshold. The support ribs 57 in this embodiment provide enhanced support along the entire length of the sill plate. Further, any water that collects on the upper surfaces of the threshold assembly or that flows down the jambs necessarily is directed to the drain channels 64 and away from the assembly. Accordingly, deterioration and rot caused by water seepage beneath the assembly is eliminated.

Also eliminated by the present embodiment is the rot and deterioration that is common at the bottom ends of wooden jamb and brick molds attached to traditional multi-piece threshold assemblies. This is because the jamb boots at the ends of the assembly are integrally formed with the plastic body and there are no joints at which water leakage can occur. Further, the square-cut bottom ends of the jamb and brick mold rest atop the upper surfaces of the jamb boots to prevent water collection, seepage, and wicking into the bottoms of these wooden components. As a result, water leakage, deterioration, and rot, both at the jamb bottoms and underneath the threshold assembly, are virtually eliminated with threshold assemblies of the present invention.

Figure 10:
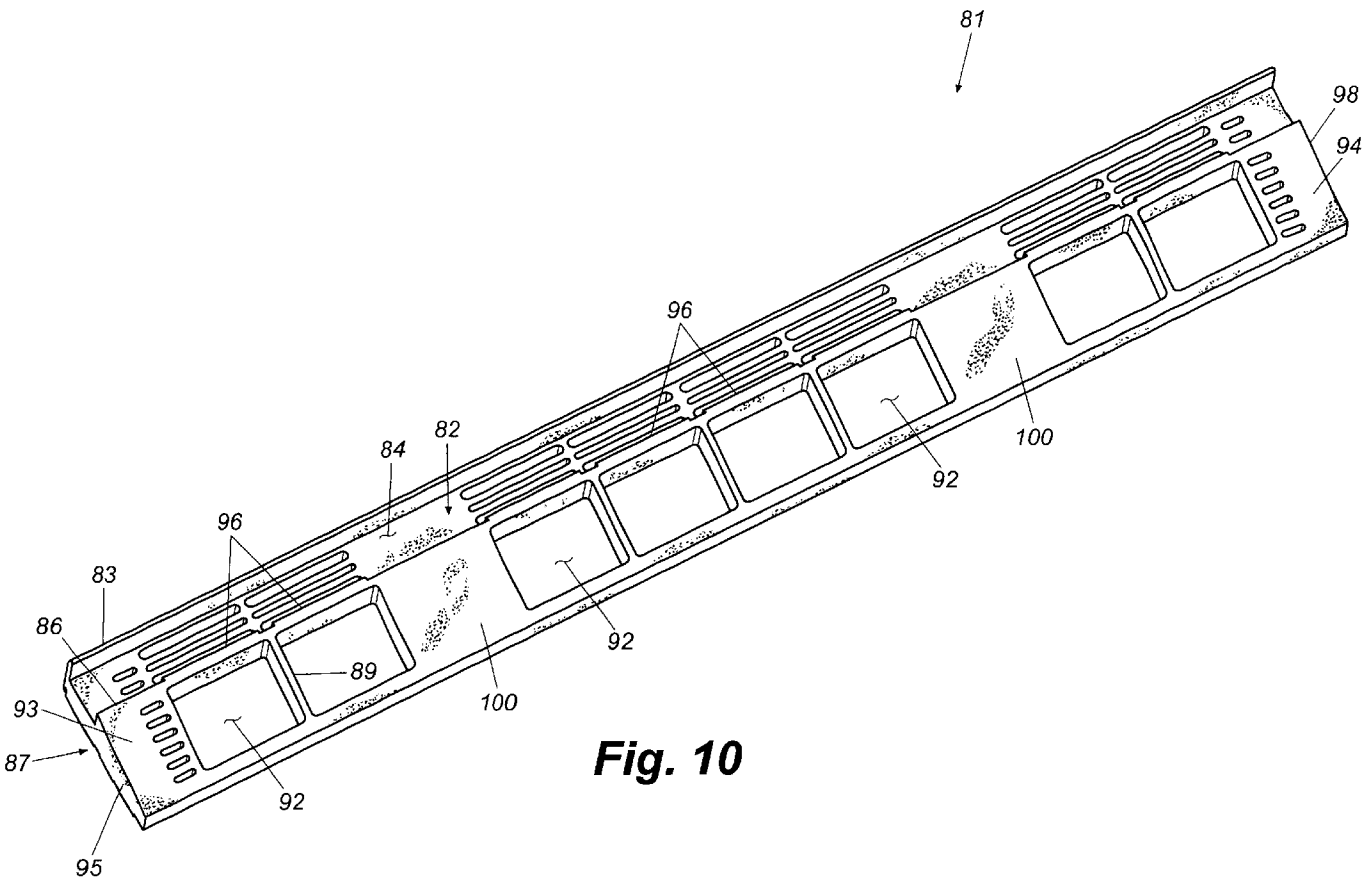
FIG. 10 is a perspective view of a compression molded threshold body that embodies principles of the invention in an alternate form.

FIGS. 10–13 illustrate a threshold assembly with unitary molded substrate subassembly that embodies principles of the invention in an alternate form. FIG. 10 is a perspective view of the molded body that forms the subassembly. The body 81 preferably is compression molded from a slightly blown cellular plastic composite material comprised of an appropriate plastic such as, for example, polypropylene, that is mixed with a filler and stabilizer such as, for example, wood flour, rice hulls, or the like. The filler may comprise from about 10 percent to about 50 percent of the volume of the composite material, but preferably comprises about 20 percent. A blowing agent in relatively small amounts is added to the composite so that, after molding, the body 81 has a slightly but not heavily blown core. The result is a composite plastic body that is relatively rigid and stable, that accepts and holds fasteners such as screws, and that may be cut, shaped, and machined in a manner similar to wood.

The compression molded composite plastic body 81 is formed to define an upwardly open channel 82 that extends along the inside edge portion of the body. An upstanding nosing 83 forms the inside edge of the body and also defines the inside wall of the upwardly open channel. The floor 84 of the channel may be solid if desired, but preferably is formed with periodically placed openings and ribs as shown in FIG. 10 to reduce material usage and plastic deformation while also providing a support surface along the entire length of the channel for selectively positionable threshold caps and panel caps. An outside ledge 86 is positioned at the location of the outside wall of the upwardly open channel and an array of inwardly projecting tabs 96 are formed along the top edge of the ledge 86. The tabs 96 define respective sill plate attachment slots beneath themselves, for purposes detailed below.

A support substrate 87 extends forwardly from the upwardly open channel to an outside edge 88. The support substrate has substantially solidly formed relatively wide end portions 93 and 94 that each are provided with stress release features 97 for purposes described below. In the embodiment illustrated in FIG. 10, the support substrate is formed with an array of lateral ribs 89 separated by spaces 92. This configuration is known as an "open" rib structure. Alternatively, the spaces can be formed as depressions with a thin floor in a "block" configuration so that the bottom surface of the body forms an uninterrupted surface that sits on a subfloor. Further, the molded body of FIG. 10 is configured for a threshold assembly for use in a dual sidelight entryway wherein mull posts extend upwardly from the threshold assembly to define the door and sidelight openings. For this purpose, the support substrate 87 is formed with two solid plastic mull support regions 100 positioned to underlie and support the mull posts. Of course, for single sidelight entryways, only one mull support region need be provided, and, for an entryway with no mull posts, no mull post support regions need be provided. It will thus be understood that the body may be molded to accommodate a wide variety of entryway types, both with and without mull posts.

Figure 11:
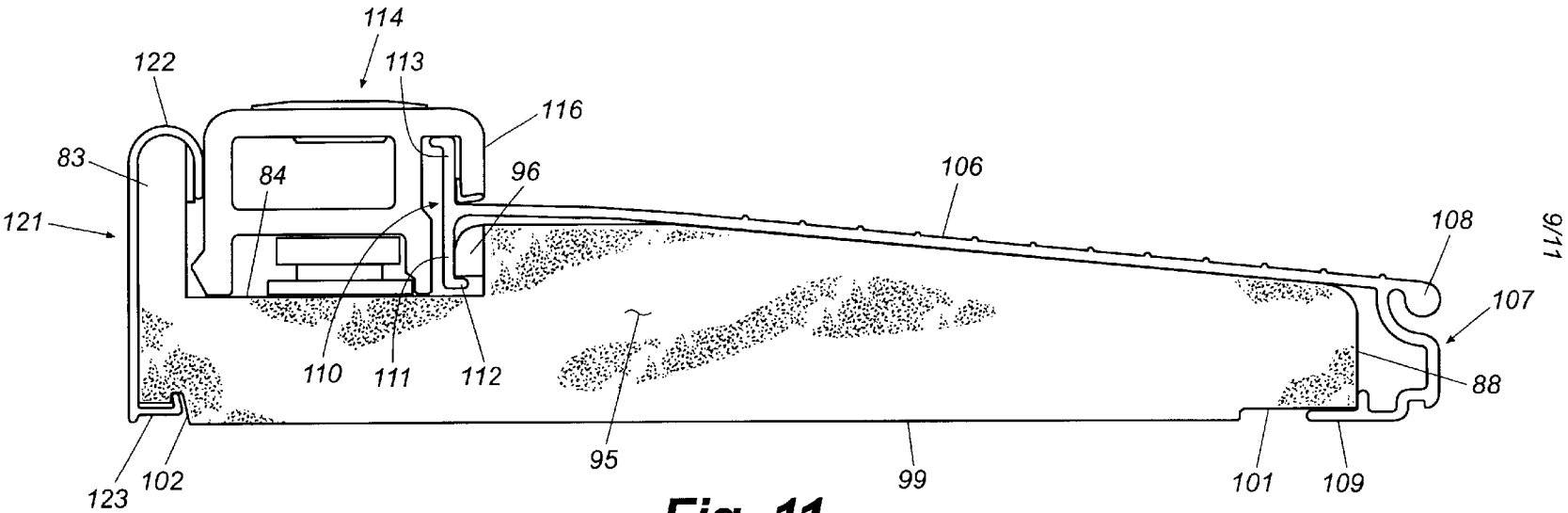
FIG. 11 is an end elevational view of the threshold body of FIG. 10 with extruded aluminum sill plate, threshold cap, and nosing cover attached.

FIG. 11 is an end view of a threshold assembly of this embodiment with its other components attached to the molded body of FIG. 10 to form the completed assembly. The end 95 of the molded body is show as is the profile of its interior nosing 83, the floor 84 of the upwardly open channel, and the inwardly projecting tabs 96 forming attachment slots. In this view, it also can be seen that an outside notch 101 is formed along the bottom of the outside edge 88 of the support substrate and an inside notch 102 is formed along the bottom of the inside edge of the molded body.

An extruded aluminum sill plate 106 is attached to the molded body covering and supported by the support substrate 87 thereof. The sill plate has a contoured outside edge portion 107 that is formed with a drip edge 108 and an inwardly extending flange 109. The flange 109 fits in the outside notch 101 to hold the outside edge of the sill plate firmly in place on the outside edge of the support substrate. The inside edge portion of the sill plate is extruded with a vertically extending wall 110 that has a downwardly projecting portion 111 with an outturned hook 112 and an upwardly projecting portion 113. When snapped into place on the plastic body, the out-turned hook 112 resides in the sill plate attachment slots beneath the several tabs 96 along the top of the outside ledge of the channel. It thus will be seen that by simply hooking the forward edge of the sill plate over the forward edge of the body and urging the rear edge of the sill plate down until its outturned hook snaps into place in the slots beneath the tabs 96, the sill plate becomes firmly and securely attached to molded body.

When the sill plate 106 is attached to the molded body, it forms the upper tread surface of the threshold assembly of this embodiment. Further, the vertical wall 110 along the inside edge of the sill plate forms the outside wall of the upwardly open channel of the assembly and forms a water dam. A threshold cap 114 can then be installed in the upwardly open channel as shown. The threshold cap may take on a variety of configurations including a simple non-adjustable plastic cap, a traditional wooden cap, or a vertically adjustable threshold cap such as that disclosed in our U.S. Pat. No. 5,426,894. In the later case, the threshold cap becomes selectively positionable along the length of the channel to any desired location so that the threshold assembly is adaptable to left or right sidelight entryways, double sidelight entryways, and other entryway configurations. Preferably, but not necessarily, the threshold cap includes an overlapping lip 96 that rides over the upwardly projecting portion 113 of the vertical wall to provide a pleasing appearance and to help inhibit water from breaching the dam in a blowing rainstorm.

In the illustrated embodiment, an extruded plastic nosing cover 121 is snapped in place covering the inside nosing 83 of the molded body to cover the nosing and provide a pleasing appearance. The nosing cover 121 has a curved or hook-shaped upper edge portion 122 that fits over the top of the nosing and a barbed flange 123 that snaps into place within the notch 102 formed along the bottom inside edge of the molded body. Thus, as with the sill plate, the nosing cover is easily installed by hooking its upper edge portion over the top of the nosing and urging its bottom portion toward the molded body until the barbed flange 123 snaps into place within the notch 102.

Accordingly, with three simple fabrication steps, snapping the sill plate and nosing cover in place and inserting the threshold cap into its channel, the threshold assembly of this embodiment is completed. Even in embodiments where adjustment screws of a wooden or plastic threshold cap extend into screw bosses in the floor of the channel, the holes and screw bosses may be molded into the plastic body at the time of compression molding. Thus, installing even this more complicated adjustable threshold cap does not significantly increase the labor required to assembly the threshold assembly of this invention.

Figure 12:
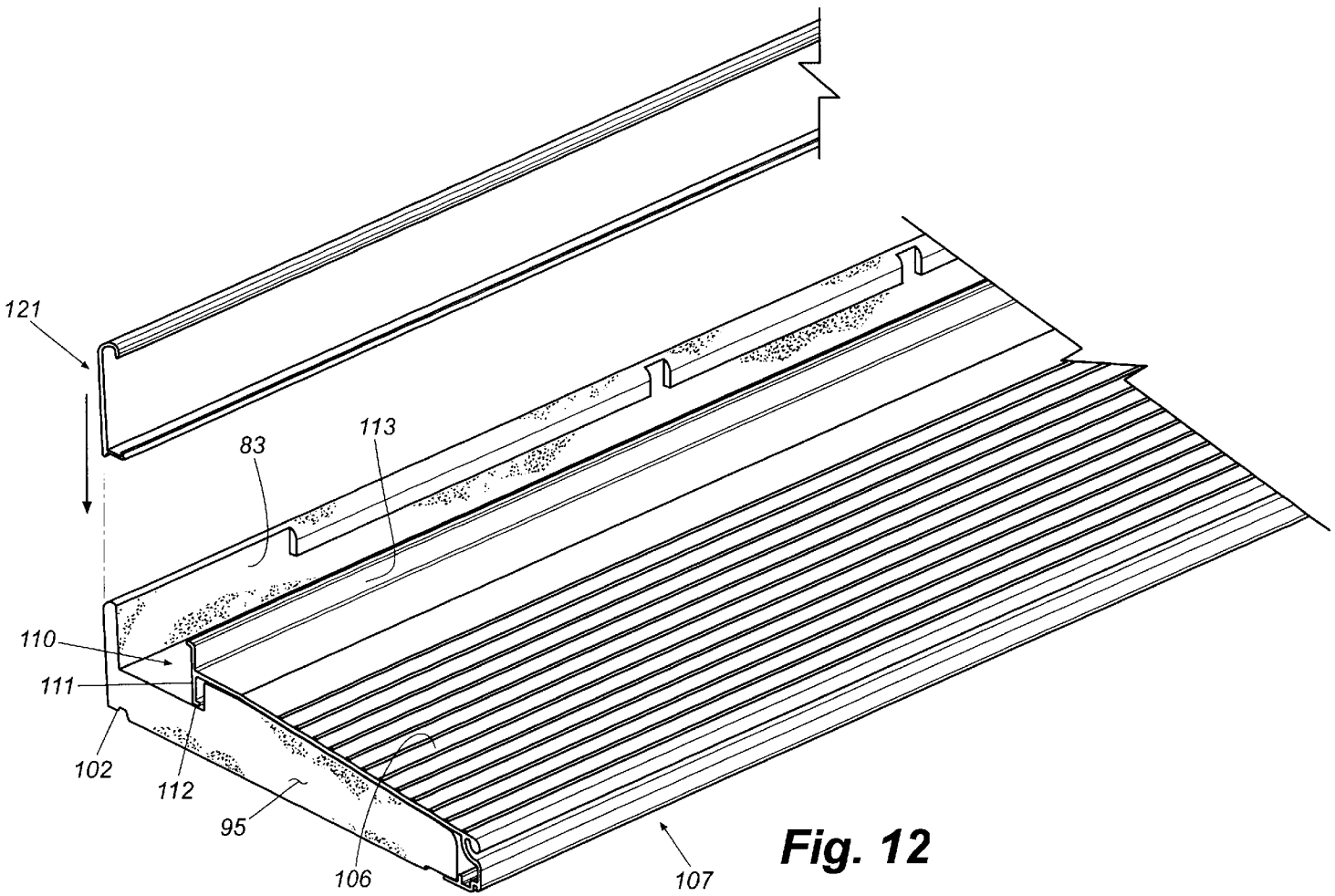
FIG. 12 is a perspective view of an end of the assembly of FIG. 11 with the nosing cover illustrated in exploded perspective.

FIG. 12 shows the threshold assembly of this embodiment without its threshold cap and with the nosing cover in exploded perspective. The extruded aluminum sill plate 106 is shown snapped into place on the molded body as described above with its vertical wall 110 forming the outside wall of the upwardly open channel of the assembly.

Figure 13:
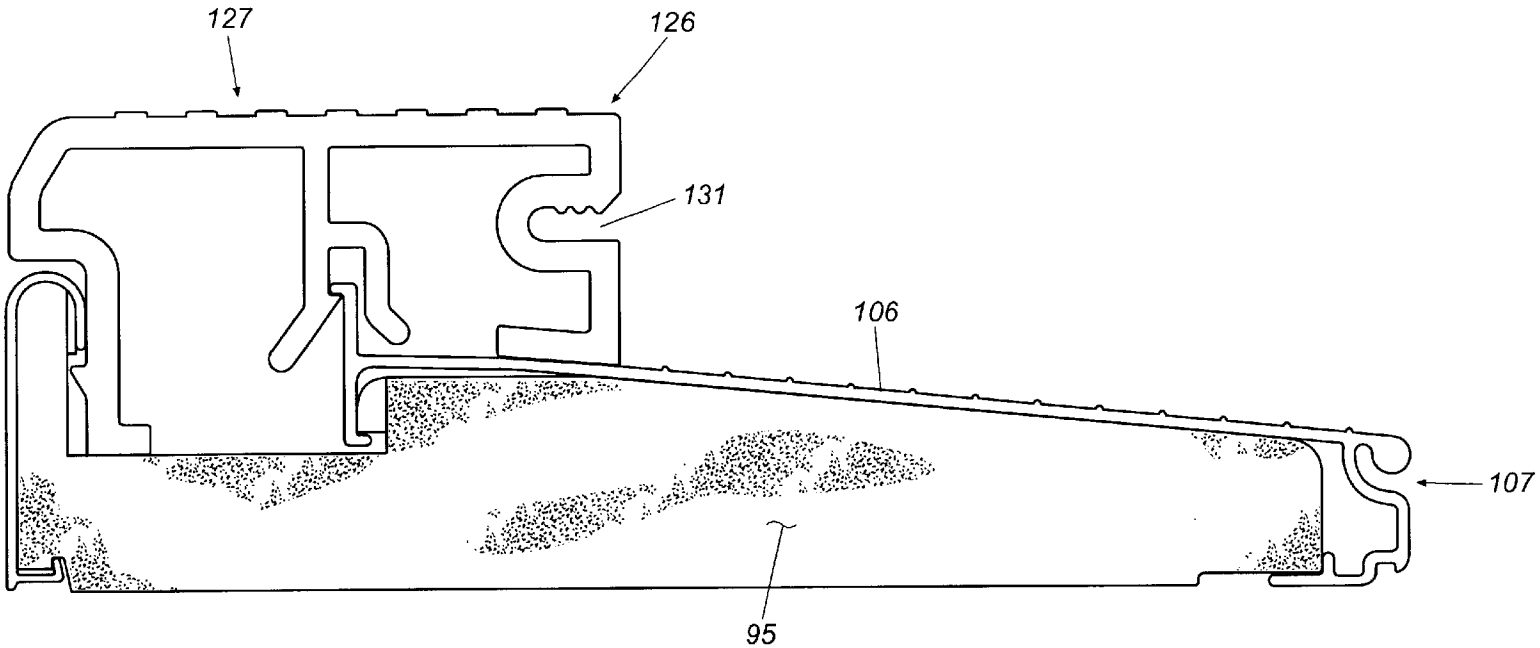
FIG. 13 is an end elevational view of the threshold body of FIG. 10 illustrating a sidelight or, alternatively, an outswing cap mounted in the upwardly open channel for underlying and supporting a sidelight panel of a sidelight entryway.

FIG. 13 is another end view of the threshold assembly of this embodiment shown with what may be a sidelight panel cap or an outswing sill cap 126 rather than a threshold cap snapped into and covering the upwardly open channel of the assembly. In the event of a sidelight cap, the upper surface 127 upon which a sidelight panel rests is sized to provide a secure support for a sidelight panel. In the event of an outswing threshold cap, a notch 131 may be formed along the outside edge of the cap to receive a length of weather stripping. In either case, the cap is selectively positionable along the length of the threshold assembly to any required position to accommodate a variety of entryway configurations. It will thus be seen that the invention, in this embodiment, comprises a threshold assembly with molded substrate subassembly that forms the upwardly open channel and the interior nosing of the threshold. Both a threshold cap and a sidelight panel cap are selectively positionable along the length of the assembly to accommodate various entryway configurations.

For installation in an entryway system spanning the bottom ends of jambs, the ends of the molded composite plastic body receive staples or screws in the same way as a wood substrate for attaching the jambs to the threshold assembly. When attached in this way, the stress relief structures 97 (FIG. 10) absorb any bulging or deformation caused by the fasteners entering the plastic and thus prevent deformation or cracking of the end portions of the plastic body. Further, since the slightly blown composite plastic material is machinable like wood, and since the end portions are formed relatively broad, the ends of the assembly may be cut if needed to accommodate various entryway widths. The wide end portions also provide for the traditional honing and notching required for installation in some entryway systems. Thus the threshold assembly of this embodiment is versatile, adaptable, and may be used in virtually any situation where a prior art threshold assembly with wooden substrate or support blocks underling the aluminum sill plate. Plastic jamb boots also may be attached to the ends of the assembly if desired or, alternatively, the plastic body may be molded with integral jamb boots as shown in FIGS. 1–9. In any case, the molded plastic body provides a superior foundation for the threshold assembly that will not swell, rot, or rack in the presence of moisture.

Threshold assemblies of this invention represent a major advance in threshold assembly fabrication techniques. This is because the entire assembly is formed by only three components; namely, the molded plastic body, the extruded aluminum sill plate, and the threshold cap (and perhaps a sidelight cap). The plastic body serves many functions including the support of the sill plate, providing drainage, eliminating rot at junctions with wooden components, and defining the channel and nosing along the inside of the assembly. Fabrication of the assembly is a simple process wherein the extruded aluminum sill plate is snapped into place on the plastic body, the threshold cap is snapped into the upwardly open channel, and, where used, a nosing cover is snapped into place on the nosing. Thus, intricate drilling, stapling, positioning, and fabrication steps required in the past are virtually all eliminated. The ultimate result is a higher quality draining and rot resistant threshold assembly that is far superior to prior art threshold assemblies.

The invention has been described herein in terms of preferred embodiments and methodologies. It will be obvious to those of skill in the art, however, that various additions, deletions, and modifications might well be made to be illustrated embodiments without departing from the spirit and scope of the invention.

What is claimed is:

1. A threshold assembly for spanning bottoms of vertical jambs of an entryway, said threshold assembly comprising:

an elongated unitarily molded body defining an upwardly open channel along an inside edge portion and a support substrate projecting outwardly from said channel to an outside edge;

a sill plate attachment slot formed in said elongated body;

a sill plate mounted on said body covering and supported by said support substrate, said sill plate having an outside edge portion profiled to fit over said outside edge of said support substrate, and an inside edge;

said molded body being formed with an upstanding nosing along said inside edge portion, said nosing forming an inside wall of said upwardly open channel;

said sill plate being formed with a vertical wall along its inside edge, a first portion of said vertical wall extending downwardly to engage with said sill plate attachment slot to secure said sill plate to said body and a second portion of said vertical wall extending upwardly to define a dam; and a threshold cap disposed in said upwardly open channel for underlying a closed door.

2. A threshold assembly as claimed in claim 1 and wherein said unitarily molded body is made of plastic.

3. A threshold assembly as claimed in claim 1 and wherein said unitarily molded body is made of a plastic composite comprising a plastic and a filler.

4. A threshold assembly as claimed in claim 3 and wherein said plastic composite is blown to exhibit a cellular core structure.

5. A threshold assembly as claimed in claim 4 and wherein said filler is wood flour.

6. A threshold assembly as claimed in claim 5 and wherein said wood flour comprises about 20 percent by volume of said plastic composite.

7. A threshold assembly as claimed in claim 6 and where said plastic is polypropylene.

8. A threshold assembly as claimed in claim 1 and wherein said molded body defines a nosing along the inside edge of said body, said nosing forming an inside wall of said upwardly open channel.

9. A threshold assembly as claimed in claim 8 and further comprising a nosing cover covering said nosing.

10. A threshold assembly as claimed in claim 1 and wherein said sill plate is formed of extruded aluminum.

11. A threshold assembly as claimed in claim 1 and further comprising jamb boots integrally formed with said molded body on ends thereof.

12. A threshold assembly as claimed in claim 1 and wherein said support substrate is formed with spaced lateral ribs for supporting said sill plate.

13. A threshold assembly as claimed in claim 1 and wherein said molded body is formed with a ledge along an outside edge of said upwardly open channel and wherein said sill plate attachment slot is defined beneath at least one inwardly extending tab disposed along said ledge, said downwardly extending portion of said vertical wall covering said ledge and said at least one tab and including an outturned hook sized and positioned to extend onto said slot to hold said sill plate securely in place on said molded body.

14. A threshold assembly as claimed in claim 1 and wherein said threshold cap is a non-vertically adjustable threshold cap that may be selectively positioned along the length of said upwardly open channel to a desired location.

15. A threshold assembly as claimed in claim 1 and wherein said threshold cap is a vertically adjustable threshold cap.

16. A threshold assembly as claimed in claim 15 and wherein said upwardly open channel has a floor and wherein said adjustable threshold cap includes adjustment lugs that slidably rest on said floor so that said threshold cap may be selectively positioned along a length of said upwardly open channel to a desired position.

17. A threshold assembly as claimed in claim 1 and further comprising a sidelight panel cap disposed in said upwardly open channel, said sidelight panel cap and said threshold cap each being selectively positionable along a length of said upwardly open channel to desired positions.

18. A threshold assembly as claimed in claim 1 and wherein said support substrate is formed with spaced transversely extending ribs along its length for underlying and supporting said sill plate.

19. A threshold assembly as claimed in claim 18 and wherein said end portions of said molded body are sufficiently wide to accept fasteners to attach jambs to said threshold assembly and to allow cutting, honing, and notching operations.

20. A threshold assembly as claimed in claim 19 and further comprising stress relief features formed in said end portions of said molded body.

21. A threshold assembly as claimed in claim 19 and wherein said support substrate further includes at least one relatively wide region located intermediate said end portions.

22. A threshold assembly comprising:

a unitarily molded body defining an elongated upwardly open channel from which a support substrate extends outwardly to an outside edge;

an attachment slot formed along said molded body;

a sill plate mounted on said molded body covering and supported by said support substrate, said sill plate having an outside edge portion disposed along said outside edge of said support substrate and an inside edge portion formed with a vertical wall;

said vertical wall defining an outside wall of said upwardly open channel and having a downwardly projecting portion disposed in said attachment slot holding said sill plate in place on said body and an upwardly projecting portion forming a dam; and a threshold cap disposed in said upwardly open channel.

23. A threshold assembly as claimed in claim 22 and wherein said molded body is formed of plastic.

24. A threshold assembly as claimed in claim 22 and wherein said molded body is formed of a plastic composite comprising a plastic and a filler.

25. A threshold assembly as claimed in claim 24 and wherein said filler is wood flour.

26. A threshold assembly as claimed in claim 25 and wherein said wood flour comprises from about 10 to about 50 percent by volume of said composite.

27. A threshold assembly as claimed in claim 24 and wherein said filler is rice hulls.

28. A threshold assembly as claimed in claim 22 and wherein said molded body defines an upstanding nosing along an inside edge portion of said body and further comprising a nosing cover covering said nosing.

* * * * *

UNITED STATES PATENT AND TRADEMARK OFFICE

CERTIFICATE OF CORRECTION

PATENT NO. : 6,789,358 B2 
DATED : September 14, 2004
INVENTOR(S) : Bruce I. Procton and Joel S. Bennett It is certified that error appears in the above-identified patent and that said Letters Patent is hereby corrected as shown below:

Title page,
Item [62], Related U.S. Application Data, should read as follows:
-- Provisional application No. 60/244,937, filed on November 1, 2000. --

Signed and Sealed this

Eighth Day of February, 2005

JON W. DUDAS
*Director of the United States Patent and Trademark Office*